United States Patent [19]

Kodera et al.

[11] Patent Number: 4,893,129

[45] Date of Patent: Jan. 9, 1990

[54] PLANAR ARRAY ANTENNA

[75] Inventors: Masao Kodera, Okazaki; Seishin Mikami, Aichi, both of Japan

[73] Assignee: Nippon Soken, Inc., Nishio, Japan

[21] Appl. No.: 284,730

[22] Filed: Dec. 15, 1988

[30] Foreign Application Priority Data

Dec. 26, 1987 [JP] Japan ..... 62-331034

[51] Int. Cl.[4] ..... H01Q 1/38

[52] U.S. Cl. ..... 343/700 MS; 343/717

[58] Field of Search ..... 343/700 MS, 829, 846, 343/713, 717, 731, 767, 768, 771, 770, 795, 905

[56] References Cited

U.S. PATENT DOCUMENTS 4,603,332 7/1986 Mead et al. ..... 343/700 MS

FOREIGN PATENT DOCUMENTS 2471679 6/1981 France ..... 343/700 MS
52-147048 12/1977 Japan .
61-240703 10/1986 Japan .
62-3508 1/1987 Japan .
62-24961 6/1987 Japan .

OTHER PUBLICATIONS

"On the Modeling of Electromagnetically Coupled Microstrip Antennas—The Printed Strip Dipole", Katehi et al., IEEE Transaction on Antennas and Propagation, vol. AP-32, No. 11, Nov. 1984, pp. 1178-1186.

*Primary Examiner*—Joseph E. Clawson, Jr.
*Assistant Examiner*—Michael C. Wimer
*Attorney, Agent, or Firm*—Cushman, Darby & Cushman

[57] ABSTRACT

In a planar array antenna in which radio frequency power fed by a feeder line is radiated from a plurality of radiation elements disposed in a planar state on one surface of a dielectric substrate on the other surface of which the feeder line is disposed, the feeder line has a first feeder part and a second feeder part. The first feeder part is spaced apart by a predetermined distance from the marginal contour of one of the radiation elements in the planar direction of the dielectric substrate, while the second feeder part is located within the width of the marginal contour of another one of the radiation elements and directly beneath the latter radiation element, and the second feeder part is divided into two parts with respective ends thereof confronting each other, the power coupling coefficient between the second feeder part and said another one radiation element is selected to be larger than that between the first feeder part and said one of the radiation elements, thereby making the planar array antenna operate with high radiation efficiency and small side lobes.

5 Claims, 6 Drawing Sheets

PLANAR ARRAY ANTENNA

BACKGROUND OF THE INVENTION

1. FIELD OF THE INVENTION

This invention relates to a planar array antenna including radiation elements in the form of microstrips, and more particularly to an antenna of the kind described above which is suitable for use in, for example, a Doppler radar which detects the ground speed of a body moving relative to the ground.

2. DESCRIPTION OF THE RELATED ART

FIG. 12 shows the directivity of a prior art planar array antenna, and it will be seen in FIG. 12 that undesirable side lobes SL tend to appear besides a main lobe ML of the directivity. FIG. 13 is a schematic plan view of another prior art planar array antenna in which distances $d_1, d_2, \ldots, d_m, \ldots, d_N$ between the centerline of a continuous feeder line 6 and the centers of radiation elements 81 to 85 are suitably selected respectively to provide a desired amplitude distribution, so that undesirable side lobes of the directivity of the antenna can be set at a desired level. In FIG. 13, reference numerals 9, 20 and 21 designate a substrate made of a dielectric material, a transmitter acting as a signal source, and a matching load, respectively.

However, in the case of the prior art antenna structure, the power coupling coefficient (the ratio between the power radiated into the space as radio waves and the total input power) is as small as of the order of 0 to 0.4. Therefore, when such a planar array antenna has a small number of radiation elements or it is designed to have side lobes of a low level, it is necessary to use a matching load 21 to thereby consume a part of the power as shown in FIG. 13. As a result, the radiation efficiency is inevitably reduced.

On the other hand, when it is intended to raise the power coupling coefficient, the degree of matching between the feeder line and the radiation elements is degraded, which rendered the prior art planar array antenna design difficult to attain the above object.

SUMMARY OF THE INVENTION

With a view to solving the prior art problem described above, it is an object of the present invention to provide a planar array antenna structure which can radiate a greater proportion of input power into the space with high radiation efficiency even when the antenna includes a small number of radiation elements or reducing of the side lobes is required.

In the planar array antenna of the present invention which solves the prior art problem, a feeder line extending beneath a plurality of radiation elements is divided at a portion underlying at least one of the radiation elements into an input feeder line and an output feeder line to thereby form a second feeder part of the feeder line, and the associated radiation element acts also as a means for effecting power transmission from the input feeder line toward the output feeder line. Thus, it is possible to form a portion exhibiting a large power coupling coefficient in the feeder line.

That is, the present invention provides a planar array antenna comprising a planar grounding conductor, a planar first dielectric substrate having the grounding conductor disposed on one of its surfaces, an elongate feeder line disposed on the other surface of the first dielectric substrate to extend from one end to the other end of the first dielectric substrate, a planar second dielectric substrate having one of its surfaces disposed adjacent to the feeder line and the other surface of the first dielectric substrate, and a plurality of radiation elements for radiating radio frequency power, the radiation elements being in the form of microstrips and arrayed on the other surface of the second dielectric substrate so as to be opposite to the feeder line across the second dielectric substrate, the feeder line having a first feeder part spaced apart by a predetermined distance from the marginal contour of one of the radiation elements in the planar direction of the second dielectric substrate and a second feeder part disposed within the width of the marginal contour of another one of the radiation elements and directly beneath the another one radiation element, and the second feeder part being divided into two parts with respective ends thereof confronting each other, and the power coupling coefficient between the second feeder part and the another one radiation element being selected to be larger than the power coupling coefficient between the first feeder part and said one of the radiation elements. Thus, the planar array antenna of the present invention can increase an amount of radio wave radiation energy by having the above-mentioned structure.

With the planar array antenna of the present invention having the structure described above, the power coupling coefficient of a portion or portions of the planar array antenna can be increased so that, even when the number of the radiation elements is small or the small side lobes are required, a greater proportion of input power can be radiated into the space with high radiation efficiency.

This is because, in order to make the side lobes have a desired magnitude, it is required that the proportion of power radiated from the radiation elements arrayed above the feeder line, that is, the power distribution ratio (or the power intensity ratio) should have a predetermined value.

However, the allocation of the power coupling coefficient for the purpose of making the power distribution ratio have the desired predetermined value is not successful. When even the greatest value of the power coupling coefficient is as low as about 0.2 to 0.4, and the degree of freedom of selection of the power coupling coefficient is low, the allocation is not successful. This is because, in order to set the power distribution ratio to satisfy the desired predetermined value, the power coupling coefficient of some of the radiation elements must be selected to be extremely small, with the result that the total amount of power radiated from all the radiation elements to the space becomes small.

In contrast therewith, according to the present invention, the parts of the planar array antenna having power coupling coefficients selected to be especially larger and smaller than a value hitherto used are combined in the planar array antenna. Therefore, the relative proportion of the power distribution between the adjacent radiation elements, that is, the aforementioned power distribution ratio can be set to satisfy the predetermined value, while, at the same time, the total power radiated from all the radiation elements can be increased.

In the planar array antenna according to the present invention, a greater proportion of input power transmitted along the feeder line can be radiated from plural radiation elements.

Conventionally, an antenna is known in which a matching load for the purpose of impedance matching is disposed at one end opposite to an input end of a feeder line so as to more efficiently radiate radio frequency wave power from radiation elements. However, in this known antenna, residual power remaining after the power radiation is consumed in the form of heat. The antenna of the present invention is advantageous over such a known antenna in that this wastefully consumed heat can be minimized.

BRIEF DESCRIPTION OF THE DRAWINGS

FIGS. 1 to 6 are views which illustrate a first feeder part and a second feeder part included in the planar array antenna of the present invention, wherein:

FIG. 1 is a schematic perspective view of a planar array antenna having a first feeder part;

FIG. 2 is a schematic plan view of a part of FIG. 1;

FIG. 3 is a schematic plan view of a part of a planar array antenna having a second feeder part;

FIG. 4 is a schematic sectional view taken along the line IV—IV in FIG. 3;

FIG. 5 is a graph showing the relation between the dimension d and the power coupling coefficient of the first feeder part shown in FIG. 2; and FIG. 6 is a graph showing the relation between the dimension L2 and the power coupling coefficient of the second feeder part shown in FIG. 3.

DESCRIPTION OF THE PREFERRED EMBODIMENTS

Differences between a first feeder part and a second feeder part will be first described before describing the embodiments of the present invention in detail, so that the present invention can be more clearly understood.

Figure 1:
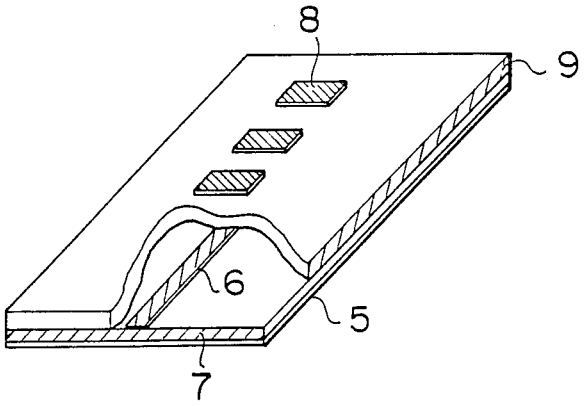
Figure 2:
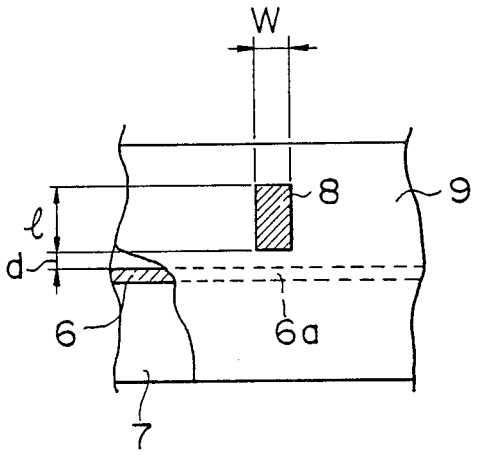

The first feeder part is shown in FIGS. 1 and 2. Referring to FIG. 1, a planar array antenna includes a first dielectric substrate 7 and a second dielectric substrate 9. The first dielectric substrate 7 has a planar grounding conductor 5 disposed on one surface and a feeder line 6 formed on the other surface, and the second dielectric substrate 9 has a plurality of rectangular radiation elements 8 formed only on one surface thereof. The radiation elements 8 are spaced apart by a predetermined distance from each other. The two dielectric substrates 7 and 9 are firmly bonded together by using a bonding film (not shown) under heating and pressing treatment. The positional relation between each of the radiation elements 8 and the feeder line 6 is determined to determine the power coupling coefficient between each radiation element 8 and the feeder line 6 to thereby provide predetermined directivity. When the value of the power coupling coefficient between any one of the radiation elements 8 and the feeder line 6 smaller than a predetermined value is required, the distance d between the feeder line 6 and the radiation element 8 is adjusted to provide the predetermined power coupling coefficient as shown in FIG. 2. In FIG. 2, the reference symbol l designates the length of the marginal contour of the radiation element 8, and the feeder line 6 is positioned apart from a side of the marginal contour of the radiation element 8. Namely, the feeder line 6 is spaced apart from a nearest side of the marginal contour of the radiation element 8 by a predetermined distance d in the planar direction of the second dielectric substrate 9. Thus, the feeder line 6 shown in FIG. 2 constitutes the first feeder part **6*a***.

Figure 3:
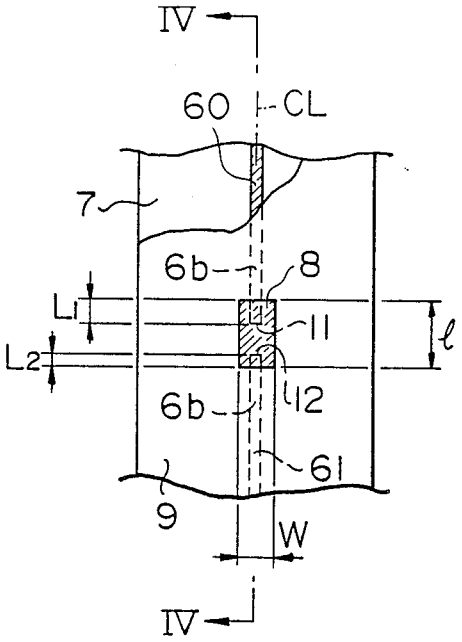
Figure 4:
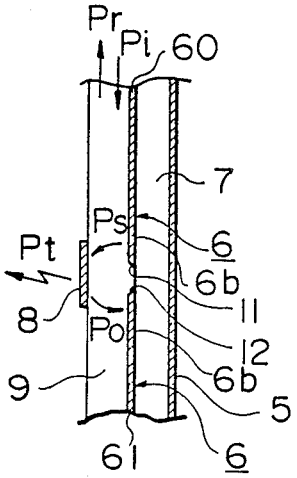

On the other hand, when the power coupling coefficient having a value larger than the predetermined value is required, the radiation element 8 is disposed in such a relation that the center of the radiation element 8 registers with the centerline CL of the feeder line 6 as shown in FIGS. 3 and 4. The feeder line 6 is divided into two parts, that is, an input-side feeder line 60 and an output-side feeder line 61, and the distance L1 between the end 11 of the input-side feeder line 60 and the marginal contour of the radiation element 8 is set so that almost all of power transmitted along the input-side feeder line 60 can be fed to the radiation element 8. Also, the distance L2 between the end 12 of the output-side feeder line 61 and the marginal contour of the radiation element 8 is so set that a predetermined proportion of the power fed to the radiation element 8 is transmitted to the output-side feeder line 61.

That is, the input-side and output-side feeder lines 60 and 61 of the feeder line 6 shown in FIG. 3 are divided to terminate in the respective ends 11 and 12 which are located within the width W of the marginal contour of the radiation element 8 and lie directly beneath the radiation element 8 without deviating from the width W of the marginal contour of the radiation element 8. These distances L1 and L2 are determined so that the dimension of the spacing between the confronting ends 11 and 12 of the input-side and output-side feeder lines 60 and 61 is smaller than the length ( of the radiation element 8 in the extending direction of the feeder line 6. The portions of the input-side and output-side feeder lines 60 and 61 adjacent to the radiation element 8 and including their ends 11 and 12 shown in FIG. 3 constitute the second feeder part **6*b***.

The operation of the two feeder parts, that is, the first and second feeder parts **6*a* and 6*b* having the aforementioned structures will now be described. In the structure of the planar array antenna shown in FIGS. 1 to 4, the radiation elements 8 and the feeder line 6 are not formed on the same plane, and the feeder line 6 is formed on the first substrate 7, while the radiation elements 8 are separately formed on the second substrate 9. Therefore, the radiation elements 8 do not contact the feeder line 6, and the value of the predetermined dimension d between the feeder line 6 and the marginal contour of the radiation element 8 shown in FIG. 2 can be selected to be smaller than zero, so that the second feeder part 6*b* shown in FIGS. 3 and 4** can be provided.

Figure 5:
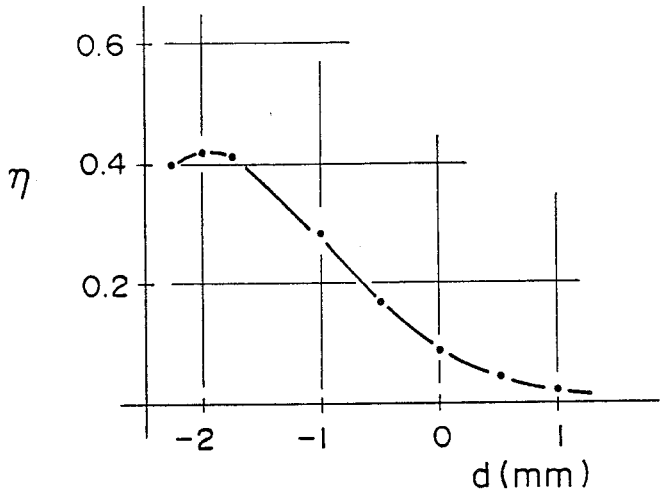

FIG. 5 is a graph showing the relation between the dimension d and the power coupling coefficient $\eta$ between each radiation element 8 and the feeder line 6 actually measured on the first feeder part **6*a* shown in FIG. 2 wherein h=0.792 mm (dielectric substrate thickness), $\epsilon_r=2.5$, f=10.4 GHz, W=6 mm and l=9.3 mm. The power coupling coefficient 0 can be changed up to a maximum value of 0.4 in relation to the predetermined dimension d shown in FIG. 2. In the case of the second feeder part 6b shown in FIGS. 3 and 4, power Pr, which is a part of power Pi transmitted along the input-side feeder line 60, is reflected at the end 11 of the input-side feeder line 60. However, the remaining power Ps (Ps=Pi−Pr) is transmitted to the radiation element 8 because this radiation element 8 is electromagnetically coupled to the input-side feeder line 60. Thus, when the distance L1 between the end 11 of the input-side feeder line 60 and the marginal contour of the radiation element 8 is changed, the amount of the reflected power Pr changes correspondingly. Therefore, by suitably selecting the predetermined value of this distance L1, the amount of the reflected power Pr can be minimized, and almost all of the power Pi transmitted along the input-side feeder line 60 is transmitted to the radiation element 8. Similarly, power Po, which is a part of the power Ps transmitted to the radiation element 8 through the electromagnetic coupling, is transmitted to the output-side feeder line 61**, and the remaining power Pt (Pt=Ps−Po) is radiated into the space. Therefore, the radiation power coupling coefficient $\eta_t$ is expressed by the following equation (3):

$$\eta_t = Pt/Pi = (Ps-Po)/Pi \quad (3)$$

Since the relation Ps≈Pi holds when the distance L1 shown in FIG. 3 is set at a predetermined value to minimize the amount of the reflected power Pr, the equation (3) is now expressed by the following equation (4):

$$\eta_t = (Pi-Po)/Pi = 1-(Po/Pi) \quad (4)$$

Figure 6:
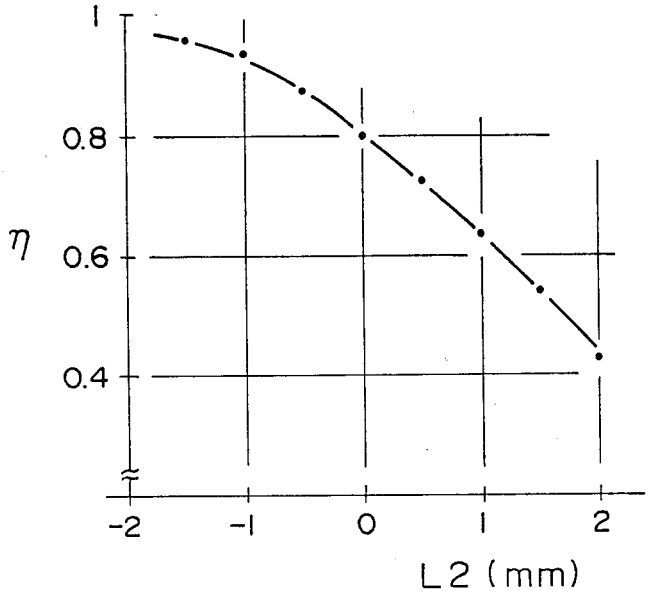

It will be seen from the equation (4) that the radiation power coupling coefficient $\eta_t$ changes according to the value of the power Po transmitted to the output-side feeder line 61, and the value of the power Po can be changed by changing the distance L2 between the end 12 of the output-side feeder line 61 and the marginal contour of the radiation element 8. FIG. 6 is a graph showing the relation between the dimension L2 and the power coupling coefficient $\eta$ between each radiation element 8 and the input-side feeder line 60 which has been actually measured wherein f=10.4 GHz, W=6 mm, l=9.3 mm and L1=2.6 mm. It will be seen in FIG. 6 that the power coupling coefficient $\eta$ can be increased up to a very large value.

Figure 7:
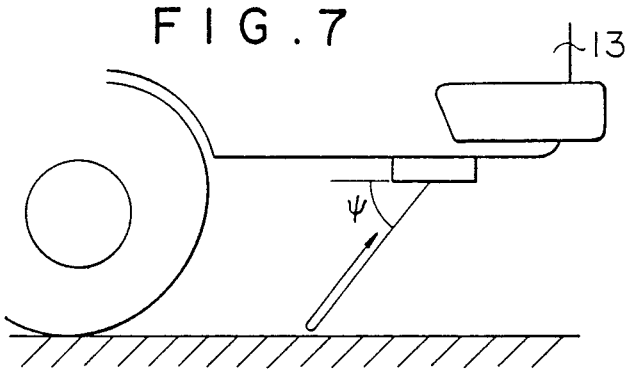
FIG. 7 is a schematic side elevation view showing an embodiment of the planar array antenna of the present invention when it has been mounted on an automotive vehicle.

A first embodiment of the planar array antenna of the present invention will now be described with reference to a case where the present invention is applied to an antenna used for sensing the ground speed of an automotive vehicle. As shown in FIG. 7, this antenna is mounted on a lower part of the body of the vehicle 13. When the antenna is used for sensing the ground speed of the vehicle 13, it is required that the center line of the beam radiated from the antenna makes a predetermined beam inclination angle $\psi$ with the direction of the movement of the vehicle 13 as shown in FIG. 7 and that the directivity of the side lobes is small.

Figure 8:
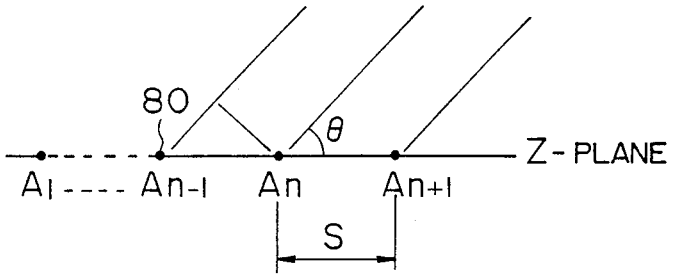
FIG. 8 illustrates the relation between the radiation elements and the antenna directivity of the planar array antenna of the embodiment of the present invention.

FIG. 8 shows that a plurality of radiation elements 80 are arranged on the Z-plane to be equally spaced apart from each other by a distance S, thereby forming a planar array antenna. When these radiation elements 80 are excited with the excitation intensity $A_1, A_2, A_3, \ldots, A_n, A_{n+1}$, respectively, while successively shifting the excitation phase by $\delta$, the directivity D ($\theta$) of the antenna is generally given by the following equation (5):

$$D(\theta) = \sum_{n=o} A_n \cdot e^{j(n-1)\delta} \cdot e^{j(n-1)\frac{2\pi}{\lambda'} \cdot S\cos\theta} \quad (5)$$

where, $A_n$ amplitude intensity ratio;
n : number of radiation elements;
e : exponential function;
j : imaginary number;
$\delta$: phase difference [rad];
$\lambda'$: wavelength in free space [m];
S : spacing [m]; and
$\theta$: angle [rad]between a radiation direction and the direction of the radiation elements array.

It will be seen from the equation (5) that the beam inclination angle $\Psi$ shown in FIG. 7 varies depending on the spacing S between the radiation elements 80 and the phase difference $\delta$ and that the magnitude of the side lobes and the half-power width change depending on the excitation intensity of the individual radiation elements 80. Here, the half-power width described above designates an angle [rad]between the two directions in which the radiation power intensity is one-half the peak value of the lobe.

Figure 9:
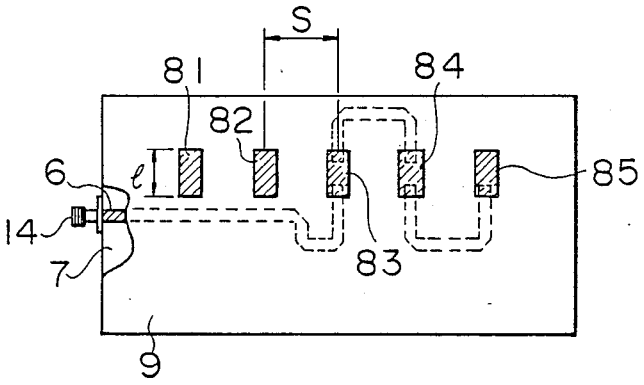
FIG. 9 is a schematic plan view of the planar array antenna of the illustrated embodiment of the present invention.

FIG. 9 is a schematic plan view showing in detail the structure of the first embodiment of the present invention when used as an antenna for sensing the ground speed of the vehicle 13. This antenna is housed in a casing (not shown) and is mounted on a lower part of the body of the vehicle 13.

When it is intended to design an antenna which satisfies the conditions such that the beam inclination angle $\Psi=25°$, the half-power width $\Psi_H=27°$, and the ratio R between the main lobe and the side lobes=20 dB or more, by assuming that the number n of the radiation elements=5, the spacing S of the radiation elements=0.484 $\lambda'$ (where $\lambda'$ denotes the wavelength in free space), and the phase difference $\delta=-84°$ in the equation (5), the excitation intensity ratio between the individual radiation elements 81, 82, 83, 84 and 85 is given by the following equation (6):

$$A_1:A_2:A_3:A_4:A_5 := 1:1.75:2.1:1.75:1 \quad (6)$$

Thus, when it is intended to make the ratio R between the main lobe and the side lobes have a value equal to or larger than a predetermined value, the excitation intensity ratio $A_1:A_2:A_3:A_4:A_5$ between the individual radiation elements 81, 82, 83, 84 and 85 should have a predetermined value. Such a restrictive condition is the starting point of the reason why the present invention is required.

Referring to FIG. 9, high frequency signal power supplied via an input connector plug 14 is transmitted along the feeder line 6 while successively feeding power to the radiation elements 81 to 85. Therefore, power $P_N$ given by the following equation (7) is fed to the N-th radiation element counted from the radiation element 81 which is nearest to the input connector plug 14.

$$P_N = P_{in}(1-\eta_1)\cdot(1-\eta_2)\,(1-\eta_{N-1})\cdot\eta_N \quad (7)$$

where $\eta_N$ denotes the power coupling coefficient between the feeder line 6 and the N-th radiation element.

From the equations (6) and (7), the power coupling coefficients $\eta$ providing a given excitation intensity ratio are computed as follows:

$\eta_1=0.078$, $\eta_2=0.26$, $\eta_3=0.51$, $\eta_4=0.74$ and $\eta_5=0.98$.

When these power coupling coefficients are compared with those shown in FIGS. 5 and 6, it will be seen that the power coupling coefficients $\eta_1$ and $\eta_2$ match the characteristic curve shown in FIG. 5, while the power coupling coefficients $\eta_3$, $\eta_4$ and $\eta_5$ match the characteristic curve shown in FIG. 6. In other words, the radiation elements 81 and 82 utilize the first feeder part 6a shown in FIG. 2, while the radiation elements 83, 84 and 85 utilize the second feeder part 6b shown in FIG. 3. These radiation elements 81 to 85 are arranged on the second dielectric substrate 9 so that the distance d between the feeder line 6 and the radiation elements 81, 82 and the distance L2 between the respective ends of the feeder line 6 and the radiation elements 83, 84 and 85 are determined according to the relations shown in FIGS. 5 and 6, respectively, to thereby provide the power coupling coefficients $\eta_1$ to $\eta_5$ such as described above. The length l of the radiation elements 81 to 85 is selected to satisfy the relation $l \approx \lambda_g/2$, where $\lambda_g$ is the wavelength of the radio frequency wave when it is transmitted on the dielectric substrate. The portion of the feeder line 6 feeding power to the radiation elements 83, 84 and 85 is bent in the form of a crank as shown in FIG. 9. This is because, in the case of the feeding method of the type shown in FIG. 2, a current perpendicular to the axial direction of the feeder line 6 is generated in the radiation elements 81 and 82, whereas, in the case of the feeding method of the type shown in FIG. 3, a current parallel to the axial direction of the feeder line 6 is generated in the radiation elements 83, 84 and 85. The length of the bent portion of the feeder line 6 is selected so that the radiation elements 83, 84 and 85 are successively excited with a phase shift of $\delta$, and such a feeder line 6 is formed on the first dielectric substrate 7.

Figure 10:
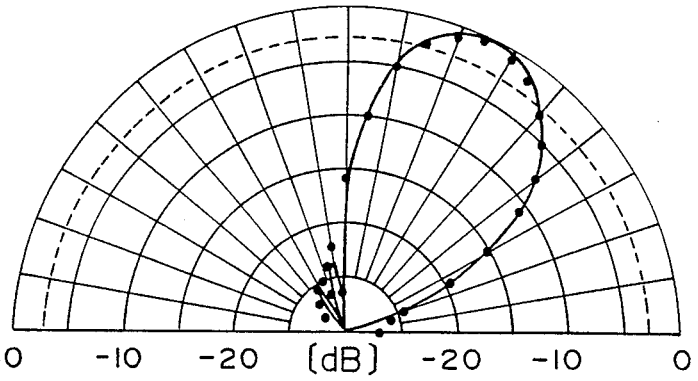
FIG. 10 shows the directivity characteristics of the planar array antenna of the illustrated embodiment of the present invention.

FIG. 10 is a graph showing the results of measurement of the directivity of the antenna shown in FIG. 9. The parameters of this antenna are as follows:

Thickness of first dielectric substrate:

$h_l=0.792$ mm

Thickness of second dielectric substrate:

$h_2=0.792$ mm

Relative permittivity of each substrate:

$\epsilon_r=2.5$

Frequency: f=10.4 GHz

Dimensions of radiation elements: l=9.3 mm, W=6 mm

It will be seen in FIG. 10 that the first embodiment of the planar array antenna of the present invention provides the desired directivity, wherein the solid curve represents calculated values and the dots represent actually measured values. Thus, according to the present invention, the power coupling coefficients between the feeder line 6 and the radiation elements 81 to 85 can be changed over a very wide range.

Figure 13:
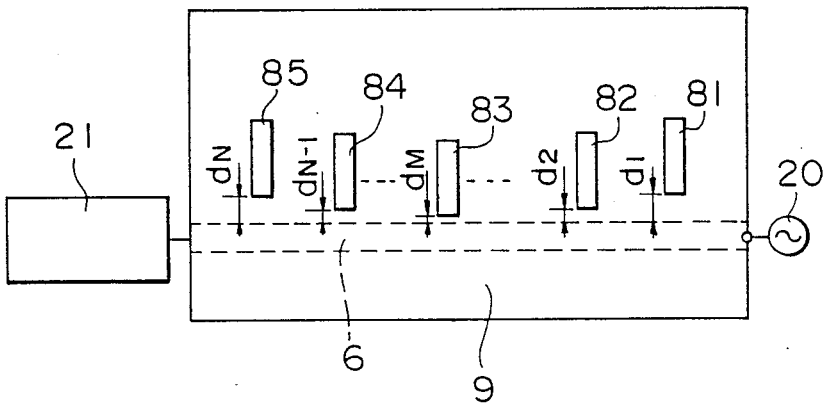
FIG. 13 PRIOR ART
FIG. 13 is a schematic plan view of another prior art planar array antenna.

Assume the case where the planar array antenna includes only the first feeder part 6a shown in FIG. 2. In such a case, the dimension d is the only parameter that must be changed to change the power coupling coefficient. In such an antenna, the variable range of the power coupling coefficient is narrowed, and, in order that the side lobe to main lobe ratio R can be selected to be equal to or smaller than a predetermined value, the excitation intensity ratio between the radiation elements must be set to a limited range of ratio. Because of such a limitation, the aforementioned power coupling coefficients $\eta_1$ and $\eta_2$ must especially be selected to have very small values. When the power coupling coefficients $\eta_1$ and $\eta_2$ have such very small values, a largest possible amount of high frequency signal power supplied to the input conhector plug 14 shown in FIG. 9 cannot be radiated from the radiation elements 81 to 85. As a result, the input power is wastefully turned into heat in a known matching load (e.g. a load 21 connected to the end of the feeder line 6 remote from the end connected to the input connector plug for the purpose of impedance matching as shown in FIG. 13).

Thus, according to the present invention, such a matching load can be eliminated, or the loss of power due to turning into heat in such a matching load can be minimized, so that any desired composite directivity can be realized without appreciably reducing the radiation power coupling efficient $\eta_t$, while lowering the level of undesirable side lobes.

In the aforementioned embodiment of the present invention, rectangular microstrip conductors are used to provide the radiation elements 8. However, it is apparent that use of microstrip conductors of any other shape, for example, a circular shape exhibits the effect similar to that described above.

Figure 11:
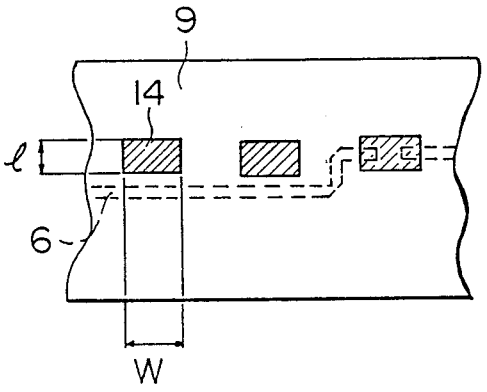
FIG. 11 is a schematic plan view of a part of another embodiment of the present invention.
Figure 12:
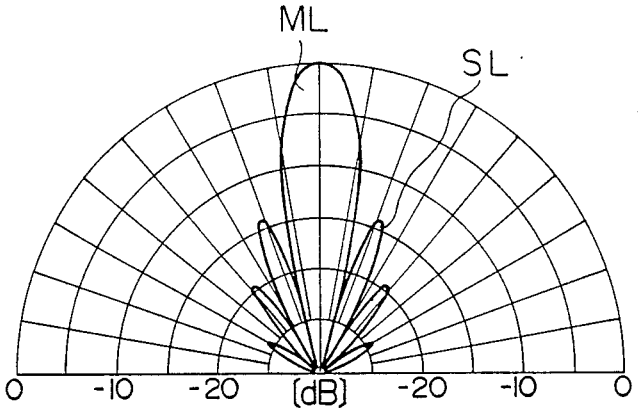
FIG. 12 PRIOR ART
FIG. 12 shows the directivity characteristics of a prior art planar array antenna whose directivity includes large side lobes.

In the above-described embodiment, when the feeding type such as shown in FIG. 2 is used, an excitation current perpendicular to the axial direction of the feeder line 6 is generated in the associated radiation elements 81 and 82. FIG. 11 shows another embodiment of the present invention. In FIG. 11, radiation elements 14 have a width W which is equal to about $\lambda_g/2$ (where $\lambda_g$ denotes the wavelength of the radio frequency wave when it is transmitted on the dielectric substrate) and a length l given by the relation $l << \lambda_g/2$. When the dimensions l and W of the radiation elements 14 are so selected, an excitation current parallel to the axial direction of the feeder line 6 is generated in the radiation elements of the FIG. 11 type arrangement so that an electric field parallel to the direction of power transmission can be generated.

The embodiment shown in FIG. 9 is a so-called patch type microstrip antenna in which microstrip conductors are bonded in an island pattern on the surface of a dielectric substrate. However, the embodiment may be modified to provide a so-called slot type microstrip antenna in which a plurality of spaced slots are formed on the surface of a single conductive sheet. In this case, the microstrip conductor elements shown by the hatching in FIG. 9 are replaced by slots, and the remaining nonhatched portion is composed of a single conductive sheet.

We claim:

1. A planar array antenna of a series-feed type comprising:

a planar grounding conductor;

a planar first dielectric substrate having said grounding conductor disposed on one of its surfaces;

an elongate feeder line disposed on another surface of said first dielectric substrate to extend from one end to another end of said first dielectric substrate, said feeder line having no branched portion;

a planar second dielectric substrate having one of its surfaces disposed adjacent to said feeder line and said other surface of said first dielectric substrate; and a plurality of radiation elements for radiating radio frequency power supplied through said feeder line, said radiation elements being arrayed on another surface of said second dielectric substrate so as to be opposite to said feeder line across said second dielectric substrate, said radiation elements being supplied said radio frequency power starting from an end radiation element positioned nearest to a feeding end of said feeder line, said feeder line having a first feeder part spaced apart by a predetermined distance from a marginal contour of one of said radiation elements in the planar direction of said second dielectric substrate and a second feeder part disposed within a width of a marginal contour of another one of said radiation elements and directly beneath said another radiation element, and said second feeder part being divided into two parts arranged along a longitudinal axis of said feeder line with respective ends thereof confronting each other, a power coupling coefficient between said second feeder part and said another radiation element being selected to be larger than a power coupling coefficient between said first feeder part and said one of said radiation elements.

2. A planar array antenna according to claim 1, wherein said respective ends of said two parts of said second feeder part are apart from each other by a distance which is selected to be smaller than the length of said another radiation element in the axial direction of said second feeder part of said feeder line.

3. A planar array antenna according to claim 1, wherein said radiation elements constitute a Doppler radar mounted on a lower part surface of an automotive vehicle body so as to be opposite to the ground.

4. A planar array antenna comprising:

a planar grounding conductor;

a planar first dielectric substrate having said grounding conductor disposed on one of its surfaces;

an elongate feeder line disposed on another surface of said first dielectric substrate to extend from one end to another end of said first dielectric substrate;

a planar second dielectric substrate having one of its surfaces disposed adjacent to said feeder line and said other surface of said first dielectric substrate; and a plurality of radiation elements for radiating radio frequency power, said radiation elements being in the form of microstrips and arrayed on another surface of said second dielectric substrate so as to be opposite to said feeder line across said second dielectric substrate, said feeder line having a first feeder part spaced apart by a predetermined distance from a marginal contour of one of said radiation elements in the planar direction of said second dielectric substrate and a second feeder part disposed within a width of a marginal contour of another one of said radiation. elements and directly beneath said another radiation element, and said second feeder part being divided into two parts with respective ends thereof confronting each other and being apart from each other by a distance which is selected to be smaller than the length of said another radiation element in the axial direction of said second feeder part, the power coupling coefficient between said second feeder part and said another radiation element being selected to be larger than the power coupling coefficient between said first feeder part and said one of said radiation elements.

5. A planar array antenna according to claim 4, wherein said microstrips arrayed on said second dielectric substrate are composed of conductor sheet elements.

* * * * *